US011408566B2

(12) United States Patent
Simon

(10) Patent No.: US 11,408,566 B2
(45) Date of Patent: Aug. 9, 2022

(54) SUBSEA HIGH INTEGRITY PIPELINE PROTECTOIN SYSTEM WITH BYPASS

(71) Applicant: Baker Hughes Energy Technology UK Limited, Bristol (GB)

(72) Inventor: Stephane Simon, Bristol (GB)

(73) Assignee: BAKER HUGHES ENERGY TECHNOLOGY UK LIMITED, Bristol (GB)

( * ) Notice: Subject to any disclaimer, the term of this patent is extended or adjusted under 35 U.S.C. 154(b) by 756 days.

(21) Appl. No.: 16/075,999

(22) PCT Filed: Feb. 17, 2017

(86) PCT No.: PCT/EP2017/053602
§ 371 (c)(1),
(2) Date: Aug. 7, 2018

(87) PCT Pub. No.: WO2017/144360
PCT Pub. Date: Aug. 31, 2017

(65) Prior Publication Data

US 2019/0219230 A1 Jul. 18, 2019

(30) Foreign Application Priority Data

Feb. 25, 2016 (GB) ..... 1603260

(51) Int. Cl.
*F17D 5/00* (2006.01)
*F17D 1/20* (2006.01)
(Continued)

(52) U.S. Cl.
CPC ..... *F17D 5/00* (2013.01); *E21B 43/01* (2013.01); *E21B 43/017* (2013.01); *F17D 1/20* (2013.01);
(Continued)

(58) Field of Classification Search
CPC ..... F17D 5/00; F17D 1/20; F17D 3/01; F17D 3/12; E21B 43/01; E21B 43/017; E21B 34/00; E21B 47/06
(Continued)

(56) References Cited

U.S. PATENT DOCUMENTS 4,852,387 A * 8/1989 Bingham ..... F16K 37/0091 73/1.72
7,044,156 B2 * 5/2006 Webster ..... F16K 17/02 137/488
(Continued)

FOREIGN PATENT DOCUMENTS

EP 2 592 318 A1 5/2013
EP 2592318 A1 * 5/2013 ..... F17D 1/20

OTHER PUBLICATIONS

Search Report and issued in connection with corresponding GB Application No. 1603260.9 dated Aug. 26, 2016.
(Continued)

*Primary Examiner* — Marrit Eyassu
(74) *Attorney, Agent, or Firm* — Baker Hughes Patent Org.

(57) ABSTRACT

A subsea high integrity pipeline protection system including a fluid inlet, a fluid outlet, a first barrier valve connected between the fluid inlet and the fluid outlet, a second barrier valve connected between the first barrier valve and the fluid outlet, and a bypass circuit which allows fluid to circumvent the barrier valves when closed, wherein the bypass circuit includes first and second bypass valves connected in series, and a third bypass valve connected in parallel to the second bypass valve.

8 Claims, 1 Drawing Sheet

(51) Int. Cl.

| | |
|---|---|
| ***F17D 3/01*** | (2006.01) |
| ***F17D 3/12*** | (2006.01) |
| ***E21B 43/01*** | (2006.01) |
| ***E21B 43/017*** | (2006.01) |
| *E21B 34/00* | (2006.01) |
| *E21B 47/06* | (2012.01) |

(52) U.S. Cl.
CPC ..... *F17D 3/01* (2013.01); *F17D 3/12* (2013.01); *E21B 34/00* (2013.01); *E21B 47/06* (2013.01)

(58) Field of Classification Search
USPC ..... 73/1.72
See application file for complete search history.

(56) References Cited

U.S. PATENT DOCUMENTS 8,051,875 B2 * 11/2011 Edwards ..... F17D 1/20 137/461
8,161,993 B2 4/2012 Ratcliffe
8,725,434 B2 5/2014 Flanders
2004/0261856 A1 * 12/2004 Klaver ..... F16K 17/04 137/487.5
2005/0199286 A1 * 9/2005 Appleford ..... F17D 3/00 137/487.5
2008/0135258 A1 * 6/2008 Daniel ..... E21B 43/01 166/363
2008/0156077 A1 * 7/2008 Flanders ..... E21B 33/03 73/49.6
2018/0245466 A1 * 8/2018 Gosney ..... E21B 21/067

OTHER PUBLICATIONS

International Search Report and Written Opinion issued in connection with corresponding PCT Application No. PCT/EP2017/053602 dated May 3, 2017.
International Preliminary Report on Patentability issued in connection with corresponding PCT Application No. PCT/EP2017/053602 dated Aug. 28, 2018.

* cited by examiner

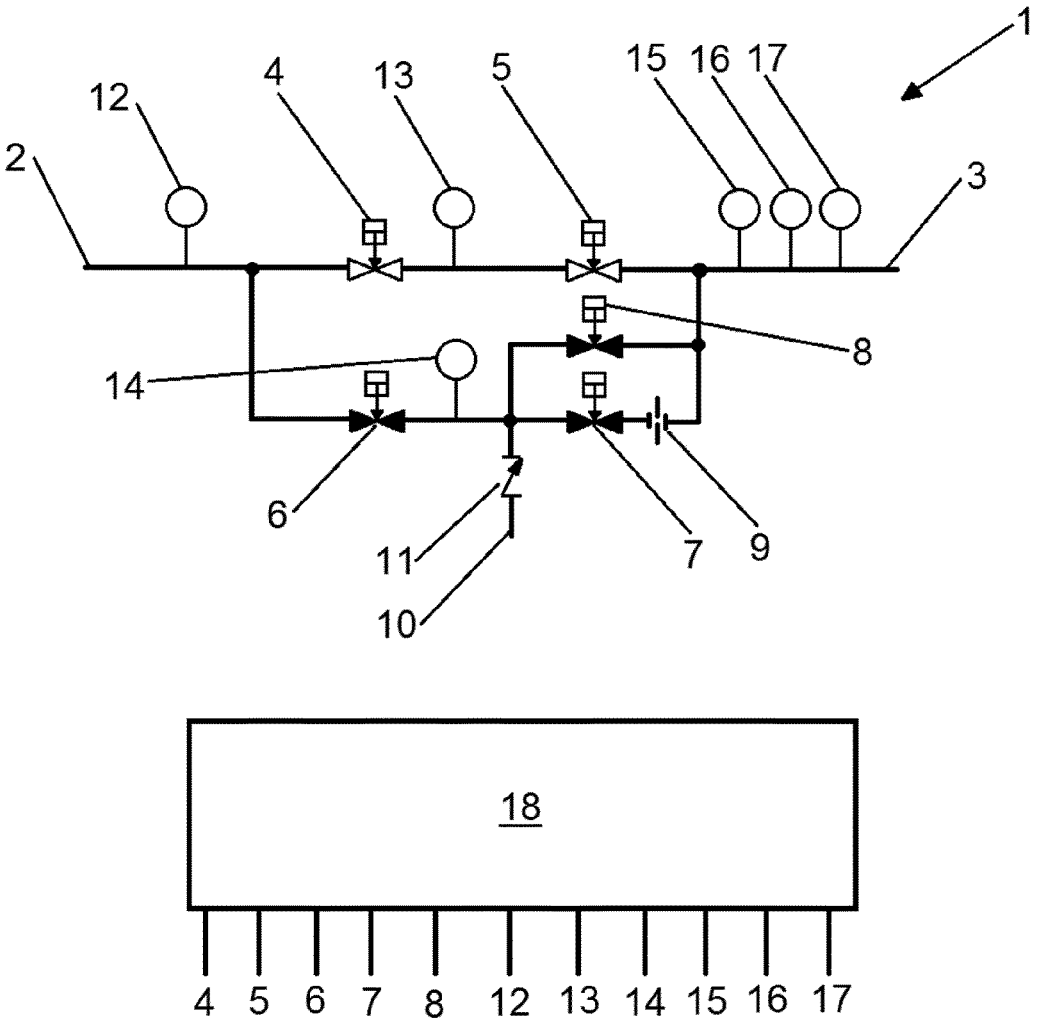
1
2
3
4
5
6
7
8
9
10
11
12
13
14
15
16
17
18
4 5 6 7 8 12 13 14 15 16 17

SUBSEA HIGH INTEGRITY PIPELINE PROTECTOIN SYSTEM WITH BYPASS

FIELD OF THE INVENTION

Embodiments of the invention relate to a subsea high integrity pipeline protection system, for example in a subsea hydrocarbon extraction facility. Embodiments of the invention also relate to a method of testing a subsea high integrity pipeline protection system.

BACKGROUND OF THE INVENTION

In hydrocarbon production lines, for example in subsea hydrocarbon extraction facilities, a single production line may receive a fluid input from a number of different hydrocarbon wells. Variations in the rate of fluid production from each well means that the pressure of the combined fluid input may become dangerously high. Downstream pipelines can be damaged by the resultant overpressure fluid.

High integrity pipeline protection systems (HIPPS), as known in the art, can prevent the transmission of overpressure fluid to downstream pipelines by closing one or more HIPPS valve, which contains the overpressure fluid to pipelines upstream of the HIPPS.

HIPPS may comprise a bypass circuit containing one or more bypass valve. The bypass circuit allows fluid to circumvent a closed HIPPS valve in the HIPPS when the bypass valve(s) are opened.

In the prior art, such bypass valves are manually operated, for example using a remotely operated underwater vehicle (ROV). This manual operation is prone to human error, and so does not result in a high degree of safety.

Embodiments of the present invention aim to overcome some of the problems associated with prior art HIPPS.

As prior art there may be mentioned U.S. Pat. No. 8,725,434, which discloses a method for diagnostics of a high integrity protections system for protection of a pipeline, U.S. Pat. No. 8,051,875, which discloses a HIPPS having a bypass line, U.S. Pat. No. 8,201,624, which discloses a HIPPS having a number of pressure sensors, U.S. Pat. No. 8,616,230, which discloses a HIPPS with sensors connected to a control module, U.S. Pat. No. 8,161,993, which discloses a HIPPS including a plurality of barrier valves and a control module, and "Delivering a HIPPS Safety Critical Control System" by Ray Phillips (accessible at https://www.onepetro.org/conference-paper/SPE-96757-MS), which discloses a HIPPS with local valve control.

SUMMARY OF THE INVENTION

According to embodiments of the present invention from one aspect, there is provided a subsea high integrity pipeline protection system comprising:

a fluid inlet;

a fluid outlet;

a first barrier valve connected between the fluid inlet and the fluid outlet;

a second barrier valve connected between the first barrier valve and the fluid outlet; and a bypass circuit which allows fluid to circumvent the barrier valves when closed;

wherein the bypass circuit includes first and second bypass valves connected in series, and a third bypass valve connected in parallel to the second bypass valve.

The system could further comprising a flow reducing device connected downstream of the second bypass valve.

The system could further comprise an injection circuit connected at a point between the first, second and third bypass valves. The injection circuit could include a one-way valve.

The system could further comprise a pressure sensor connected upstream of the first barrier valve.

The system could further comprise a pressure sensor connected between the first and second barrier valves.

The system could further comprise a pressure sensor connected at a point between the first, second and third bypass valves.

The system could further comprise three or more pressure sensors connected downstream of the second barrier valve.

The system could further comprise a logic solver connected to the first and second barrier valves, the first, second and third bypass valves and the or each pressure sensor. The logic solver could be programmed to de-energise the first and second barrier valves when at least one pressure sensor detects a pressure above a predetermined threshold.

According to embodiments of the present invention from a second aspect, there is provided a method of testing a subsea high integrity pipeline protection system comprising:

a fluid inlet;

a fluid outlet;

a first barrier valve connected between the fluid inlet and the fluid outlet;

a second barrier valve connected between the first barrier valve and the fluid outlet; and a bypass circuit which allows fluid to circumvent the barrier valves when closed;

wherein the bypass circuit includes first and second bypass valves connected in series, and a third bypass valve connected in parallel to the second bypass valve;

the method comprising:

closing the first, second and third bypass valves;

closing the first barrier valve;

closing a further valve downstream of the second barrier valve;

opening the second barrier valve;

injecting test fluid into the high integrity pipeline protection system at a point between the first, second and third bypass valves; and opening the third bypass valve.

BRIEF DESCRIPTION OF THE DRAWINGS

FIG. 1 schematically shows a subsea high integrity pipeline protection system (HIPPS) according to embodiments of the invention.

DETAILED DESCRIPTION

FIG. 1 shows a subsea high integrity pipeline protection system (HIPPS) 1. The HIPPS 1 comprises a fluid input 2 and a fluid output 3. When connected in a subsea hydrocarbon extraction facility, the fluid input 2 will typically be in fluid connection with a hydrocarbon export pipeline and the fluid output 3 will typically be in fluid connection with a riser for transferring exported hydrocarbons to a surface location.

A first safety critical HIPPS barrier valve 4 and a second safety critical HIPPS barrier valve 5 are connected between the fluid input 2 and the fluid output 3. Three safety critical bypass valves 6, 7, 8 are connected on a bypass circuit which bypasses the first and second HIPPS barrier valves 4, 5. Typically the bypass circuit will use smaller piping than the main pipeline. Bypass valve 7 and bypass valve 8 are connected in parallel to one another, and both bypass valves 7 and 8 are connected in series with bypass valve 6. A flow reducing device 9 (such as an orifice plate) is connected in the bypass circuit downstream of bypass valve 7.

Each of the valves 4-8 is 'fail closed', i.e. they require an energy input to remain open, and will automatically close in the absence of an energy input. Each of the valves 4-8 may be operated electrically or hydraulically.

A number of pressure sensors are connected to the HIPPS 1. A first pressure sensor 12 is connected to the HIPPS 1 between the fluid input 2, the first HIPPS barrier valve 4 and the bypass valve 6 as shown. A second pressure sensor 13 is connected between the first HIPPS barrier valve 4 and the second HIPPS barrier valve 5 as shown. A third pressure sensor 14 is connected between the bypass valve 6, the bypass valve 7 and bypass valve 9 as shown. A further three pressure sensors 15, 16, 17 are connected between the second HIPPS barrier valve 5, the bypass valve 7 and the bypass valve 8, and the fluid output 3 as shown.

Each of the valves 4-8 and the pressure sensors 12-17 is connected to a safety critical logic controller 18, which is operable to control energisation and de-energisation of each of the respective valves This may be done indirectly using a directional control valve (DCV) as an intermediate device between the controller and the valves.

In normal working conditions, e.g. the production of hydrocarbon fluids, fluids are transmitted from the fluid input 2 to the fluid output 3. The first and second HIPPS barrier valves 4, 5 are open (i.e. energised) and the bypass valves 6, 7, 8 are closed (i.e. de-energised).

The logic controller 18 is programmed with a logic wherein the detection of overpressure, i.e. pressure in excess of a predetermined threshold, by any of the pressure sensors 12-17 will trigger the logic controller 18 to instruct the first and second HIPPS barrier valves 4, 5 to de-energise. This prevents overpressure fluid from being transmitted from the fluid input 2 to the fluid output 3, and so prevents damage from being inflicted on pipelines downstream of the fluid output 3 by said overpressure fluid.

In order to maintain the first and second HIPPS barrier valves 4, 5 in good condition it is desirable to equalise the pressure on both sides of the valves (i.e. upstream of HIPPS barrier valve 4 and downstream of HIPPS barrier valve 5) before opening them. To achieve this, the system is reset by opening bypass valve 8 to inject remediating fluid from the injection circuit 10 and the one-way valve 11. Bypass valve 8 is closed again when fluid injection is no longer required.

Then, provided the pressure downstream of HIPPS barrier valve 5 has fallen to a safe level (this can be measured with pressure sensors 15-17), bypass valves 6 and 7 are opened. This allows fluid upstream of HIPPS barrier valve 4 to safely vent, due to the flow reducing device 9 downstream of bypass valve 7, until the pressure upstream of HIPPS barrier valve 4 has equalised with the pressure downstream of HIPPS barrier valve 5. This can be measured using pressure sensor 12 and pressure sensors 15-17. During this process, bypass valve 8 can also be opened to increase the rate of venting.

In order to confirm that the HIPPS 1 is operational, and to comply with safety regulations, it is required to conduct regular testing (e.g. annually) of all the safety critical components in the HIPPS 1. These include the valves 4-8, the sensors 15-17, the logic controller 18 and potentially sensor 14.

The HIPPS 1 can be tested by closing HIPPS barrier valve 4 (e.g. by issuing an external command to the logic controller 18), another valve downstream in the pipeline (not shown on FIG. 1) and injecting test fluid. The fluid can be injected, for example, through the injection circuit 10 and one way valve 11 by opening bypass valve 8. The injection of additional fluid through the injection circuit 10 will lead to an increase in pressure detected downstream of HIPPS barrier valve 5. If this pressure increase rises above an overpressure threshold, then the logic controller 18 will be triggered to cause HIPPS barrier valve 5 to close.

A method to measure leakage across HIPPS barrier valve 4 and bypass valve 6 is also enabled by the HIPPS 1. Leakage can be tested by opening bypass valve 6 with HIPPS barrier valve 4 closed and another valve upstream in the pipeline (not shown on FIG. 1) closed. This will cause fluid to enter the bypass circuit. The bypass valve 6 is then closed and bypass valve 8 is opened and then closed (followed by the HIPPS barrier valve 5 if necessary) so as to ensure that the pressure downstream of valves 4 and 6 is significantly below the pressure upstream of those valves. Pressure decay upstream of HIPPS barrier valve 4 and bypass valve 6 can be measured using pressure sensor 12. Similarly, leakage across HIPPS barrier valve 5 and bypass valves 7 and 8 can be tested by opening both HIPPS barrier valve 4 and bypass valve 6, and measuring pressure decay upstream of HIPPS barrier valve 5 and bypass valves 7 and 8 using any of pressure sensors 12-14.

The logic controller 18 is programmed with a logic that is intended to protect the HIPPS 1 from damage, and to prevent fluid upstream of the HIPPS 1 from being transferred across the HIPPS 1, including through the bypass circuit. The logic controller 18 logically links the pressure sensors 15-17, the HIPPS bypass valves 4, 5 and the bypass valves 6-8 in the following manner:

1) If an aggregate pressure detected by pressure sensors 15-17 is above a predetermined threshold, the logic controller 18 de-energises HIPPS barrier valve 4 and HIPPS barrier valve 5. The HIPPS barrier valves 4 and 5 can only be re-energised if the aggregate pressure detected by pressure sensors 15-17 is below a predetermined reset threshold and the bypass valves 6-8 are de-energised.
2) If an aggregate pressure detected by pressure sensors 15-17 is above a predetermined threshold, the logic controller 18 de-energises bypass valves 6-7. Bypass valves 6-7 can only be re-energised if the aggregate pressure detected by pressure sensors 15-17 is below a predetermined reset threshold.
3) Bypass valve 8 can only be energised if HIPPS barrier valve 4 and bypass valve 6 are de-energised.
4) Bypass valve 6 can only be energised if HIPPS barrier valve 5 and bypass valve 8 are both de-energised.
5) Bypass valve 7 can only be energised is HIPPS barrier valves 4 and 5 are both de-energised.

In the above, "aggregate pressure" means a combination of the measurements of the three pressure sensors 15-17, for example in a 2oo3 (two out of three) or 1oo3 (one out of three) architecture.

During normal operations, all the bypass valve 6-8 are closed and so the pressure between the bypass valves 6-8 should be ambient. The pressure in the main pipeline through the HIPPS 1 (i.e. from the fluid inlet 2 to the fluid outlet 4 through the HIPPS barrier valves 4, 5) is above ambient as fluid is flowing. Leakage in any bypass valve will cause the pressure between the bypass valves to rise to match that in the main pipeline. This increase can be measured using pressure sensor 14. As this sensor is connected to the logic controller 18, the logic controller 18 can be programmed to close the HIPPS barrier valves 4 and 5 on detection of a pressure increase by pressure sensor 14 during normal operations, so that remedial action can be taken on the HIPPS 1 before damage occurs.

While embodiments of the invention have been described above with respect to a specific circuit architecture, this is exemplary only and embodiments of the invention are not so limited. For example, a redundant bypass valve can be included in the bypass circuit in series with bypass valve 6, either upstream or downstream, to increase the level of safety. Bypass valve 7 and the flow reducing device 9 may not be present (for example flow rate reduction may be achieved by sizing valve 8 and the associated pipework). The subsea pipeline may be isolated using a single HIPPS barrier valve instead of two valves in series.

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A subsea high integrity pipeline protection system comprising:

a fluid inlet;

a fluid outlet;

a first barrier valve connected between the fluid inlet and the fluid outlet;

a second barrier valve connected between the first barrier valve and the fluid outlet;

three or more pressure sensors connected downstream of the second barrier valve;

a bypass circuit which allows fluid to circumvent the barrier valves when closed, the bypass circuit including first and second bypass valves connected in series, and a third bypass valve connected in parallel to the second bypass valve;

a flow reducing device connected downstream of the second bypass valve; and a logic solver connected to the first and second barrier valves, the first, second and third bypass valves and at least one of the three or more pressure sensors, wherein the logic solver is configured to (i) instruct the first and second barrier valves to close if any of the pressure sensors detect an overpressure condition, and (ii) instruct at least the first and the second of the first, second and third bypass valves to open to vent fluid upstream of the first barrier valve if a pressure downstream of the second barrier valve falls to a predetermined safe level.

2. The system according to claim 1, further comprising an injection circuit connected at a point between the first, second and third bypass valves.

3. The system according to claim 2, wherein the injection circuit includes a one-way valve.

4. The system according to claim 1, further comprising a pressure sensor connected upstream of the first barrier valve.

5. The system according to claim 1, further comprising a pressure sensor connected between the first and second barrier valves.

6. The system according to claim 1, further comprising a pressure sensor connected at a point between the first, second and third bypass valves.

7. The system according to claim 1, wherein the first and second barrier valves are configured to automatically close in the absence of an energy input, and the logic solver is programmed to de-energize the first and second barrier valves when at least one pressure sensor detects a pressure above a predetermined threshold.

8. A method of testing a subsea high integrity pipeline protection system comprising:

providing a subsea high integrity pipeline protection system according claim 1, the subsea high integrity pipeline protection system further comprising an injection circuit connected at a point between the first, second and third bypass valves;

closing the first, second and third bypass valves;

closing the first barrier valve;

closing a further valve downstream of the second barrier valve;

opening the second barrier valve;

injecting test fluid into the high integrity pipeline protection system at a point between the first, second and third bypass valves; and opening the third bypass valve.

* * * * *